United States Patent [19]

Hildebrandt

[11] Patent Number: 4,611,518

[45] Date of Patent: Sep. 16, 1986

[54] DEVICE FOR INTRODUCING A WEB OF MATERIAL INTO A PROCESSING MACHINE

[75] Inventor: Arno Hildebrandt, Neuss, Fed. Rep. of Germany

[73] Assignee: Jagenberg Aktiengesellschaft, Dusseldorf, Fed. Rep. of Germany

[21] Appl. No.: 642,240

[22] Filed: Aug. 20, 1984

[30] Foreign Application Priority Data

Aug. 19, 1983 [DE] Fed. Rep. of Germany ..... 3329987

[51] Int. Cl.[4] ..... B26D 7/18

[52] U.S. Cl. ..... 83/105; 83/165; 83/373; 83/408; 242/56.5

[58] Field of Search ..... 83/373, 81, 165, 105, 83/106, 150, 441, 407, 408; 242/56.1, 56.3, 56.4, 56.5, 56.6

[56] References Cited

U.S. PATENT DOCUMENTS

| | | | |
|---|---|---|---|
| 2,507,144 | 5/1950 | Christman | 242/56.6 |
| 2,512,900 | 6/1950 | Kwitch | 242/56.6 |
| 3,103,843 | 9/1963 | Schoenberger | 83/107 |
| 4,444,362 | 4/1984 | Karr | 83/408 X |

*Primary Examiner*—E. R. Kazenske
*Assistant Examiner*—John L. Knoble
*Attorney, Agent, or Firm*—Sprung Horn Kramer & Woods

[57] ABSTRACT

In a device for introducing a web of material into a processing machine that has a knife for separating at least one edge of the web and means of conveying the edge, a pair of pressure rolls that divert the edge to one side out of its original course and convey it farther and a downstream transverse knife that has guide surfaces that guide the initial section of the edge onto a feed surface and/or into rope scissors. The device can be rotated around a vertical axis.

3 Claims, 10 Drawing Figures

DEVICE FOR INTRODUCING A WEB OF MATERIAL INTO A PROCESSING MACHINE

BACKGROUND OF THE INVENTION

The present invention relates to a device for introducing a web of material into a processing machine that has a knife for separating at least one lateral strip of the web and means of conveying the strip.

A device of this kind is known, from German OS No. 3 218 306 for instance. The separated strip is forced in this device by compressed air flowing out of nozzles against sheets of metal that guide the strip into the desired processing machine. Once the strip of the web has been introduced into the processing machine, the strip ceases to be separated and the web is fed at full width into the machine that the strip has been threaded into.

Using compressed air to guide the strip involves certain drawbacks. It is also difficult to guide the strip precisely because it has to be diverted to one side out of an original path so that it will travel alongside the machine that the web is to be fed through.

SUMMARY OF THE INVENTION

The object of the present invention is to provide means of precisely and effectively guiding a strip that has been separated from a web of material that is to be fed into any type of subsequent processing machine at all.

This object is attained in accordance with the invention in a device of the aforesaid generic type by a pair of pressure rolls that divert the strip to one side out of its original path and convey it downstream and by a downstream transverse knife with guide surfaces that guide the initial section of the strip onto a feed surface and/or into rope scissors, whereby the device can be rotated around a vertical axis.

The device in accordance with the invention allows a strip separated from a web of material to be reliably captured and precisely fed into any subsequent processing machine desired. The procedure can be completely automated. Once the separated strip has been captured by the pair of pressure rolls, the whole device is rotated outward around the vertical axis in such a way that the strip will leave the rest of the web. Both the web and the separated strip will travel simultaneously into a waste collector, e.g. for return to the pulper.

In one preferred embodiment of the device, the guide surfaces on the transverse knife can be adapted to the radius of the second pressure roll.

The transverse knife is thus activated to cut the strip and the resulting fresh initial section of the strip will be conveyed by the guide surfaces on the knife, which preferably match the radius of one of the pressure rolls, to a feed surface or into rope scissors that guide it into the desired subsequent processing machine.

In another preferred embodiment, the device can also be rotated around a horizontal axis.

When the device can also be rotated around a horizontal axis, the edge can be diverted either up or down to facilitate moving it alongside subsequent processing machines.

Some preferred embodiments of the invention will now be described with reference to the attached drawings, wherein

DETAILED DESCRIPTION OF THE PREFERRED EMBODIMENTS

Figure 1:
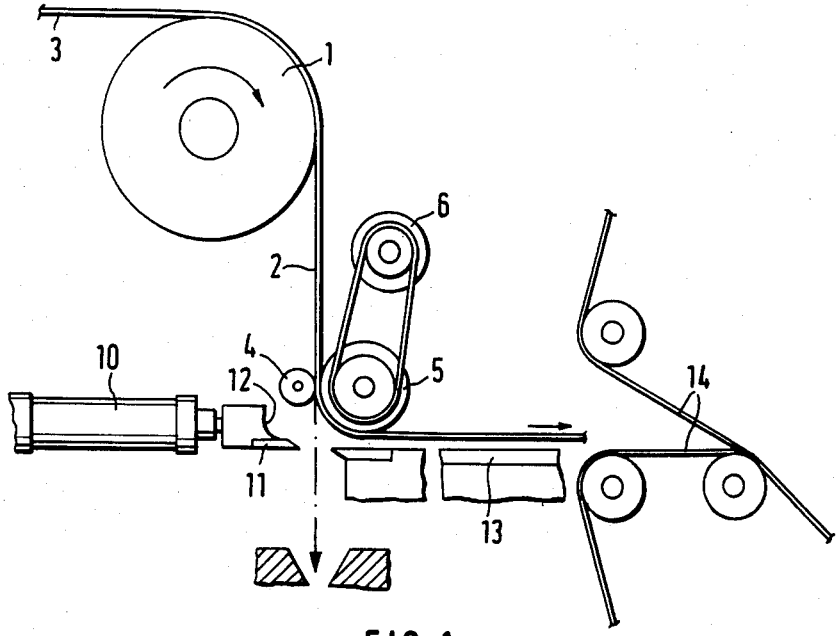
FIG. 1 is a side view of the device.
Figure 2:
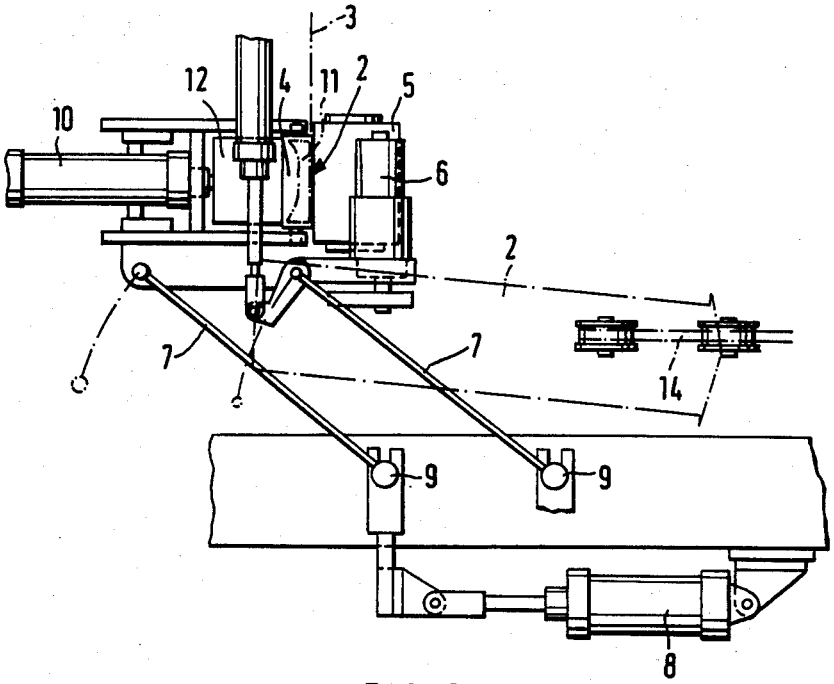
FIG. 2 is a top view of the device.
Figure 3:
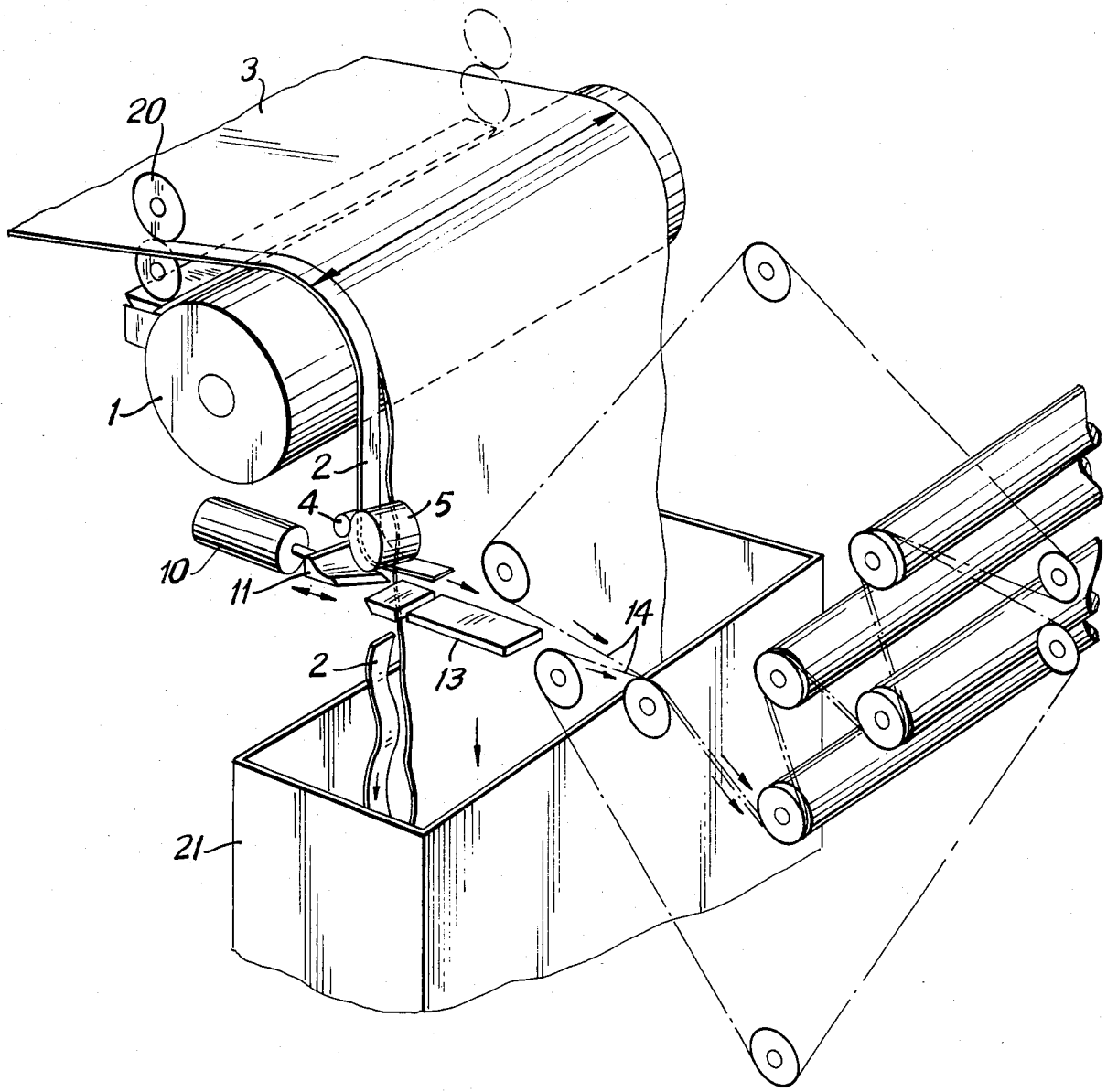
FIG. 3 is a perspective view of the device.
Figure 4:
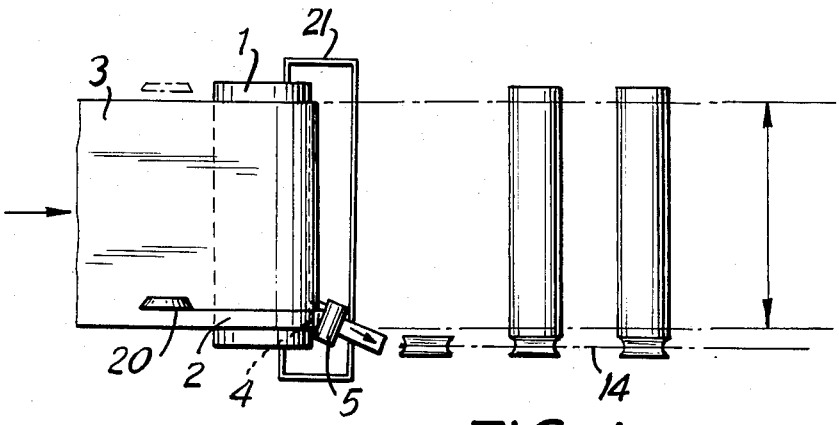
FIG. 4 is a schematic top plan view.
Figure 5:
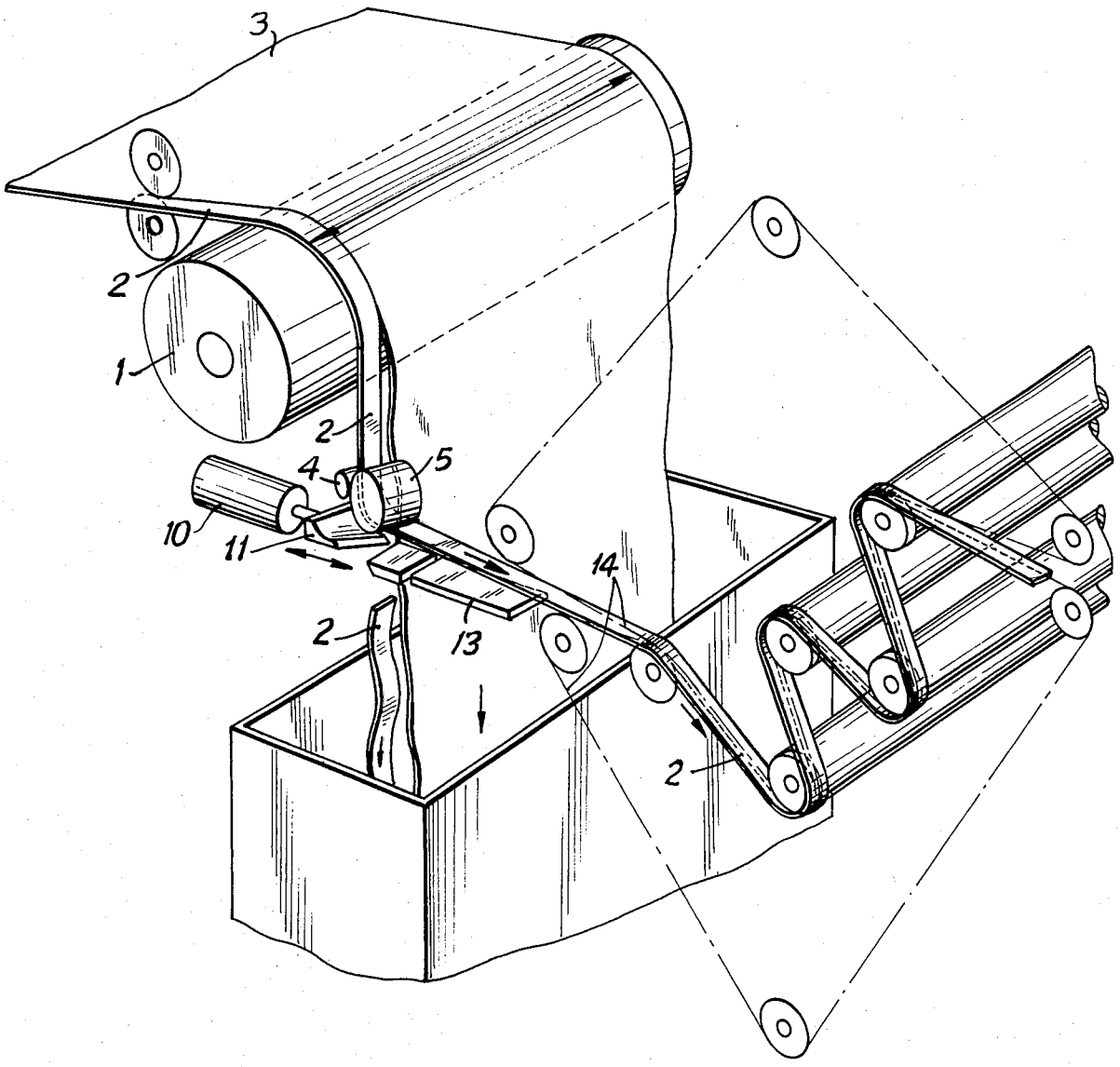
FIG. 5 is a perspective view when the lateral strip has been cut transversely and picked up by the rope scissors.
Figure 6:
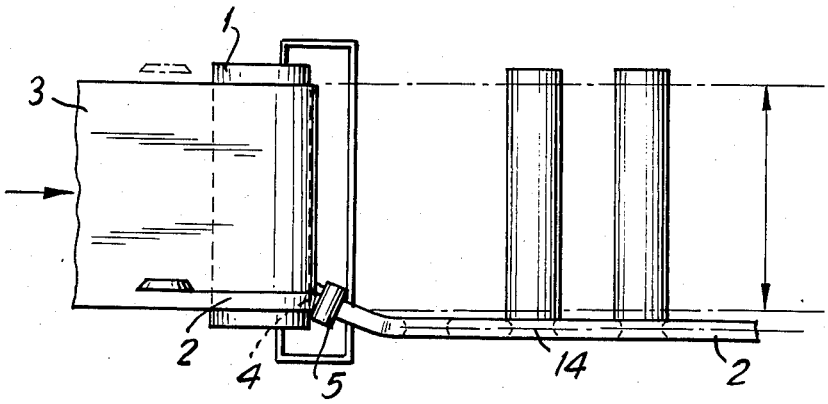
FIG. 6 is a plan view corresponding to FIG. 5.
Figure 7:
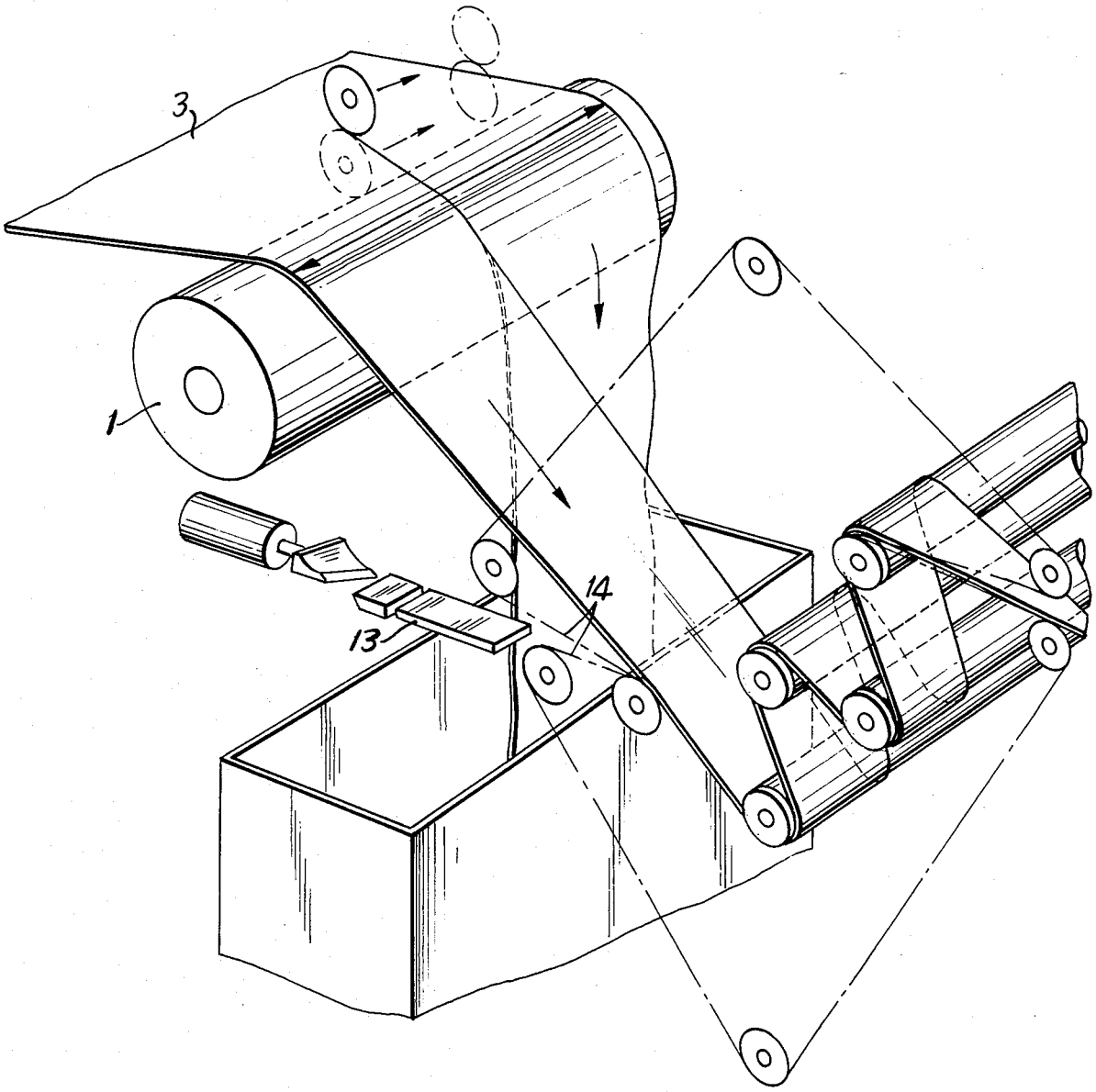
FIG. 7 is a perspective view showing the widening of the strip as the initial severing device moves transversely.
Figure 8:
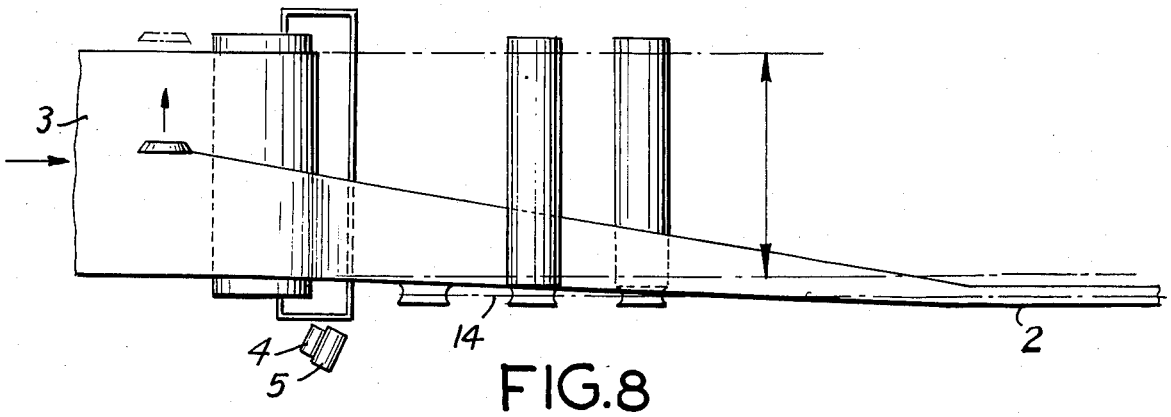
FIG. 8 is a plan view corresponding to FIG. 7.
Figure 9:
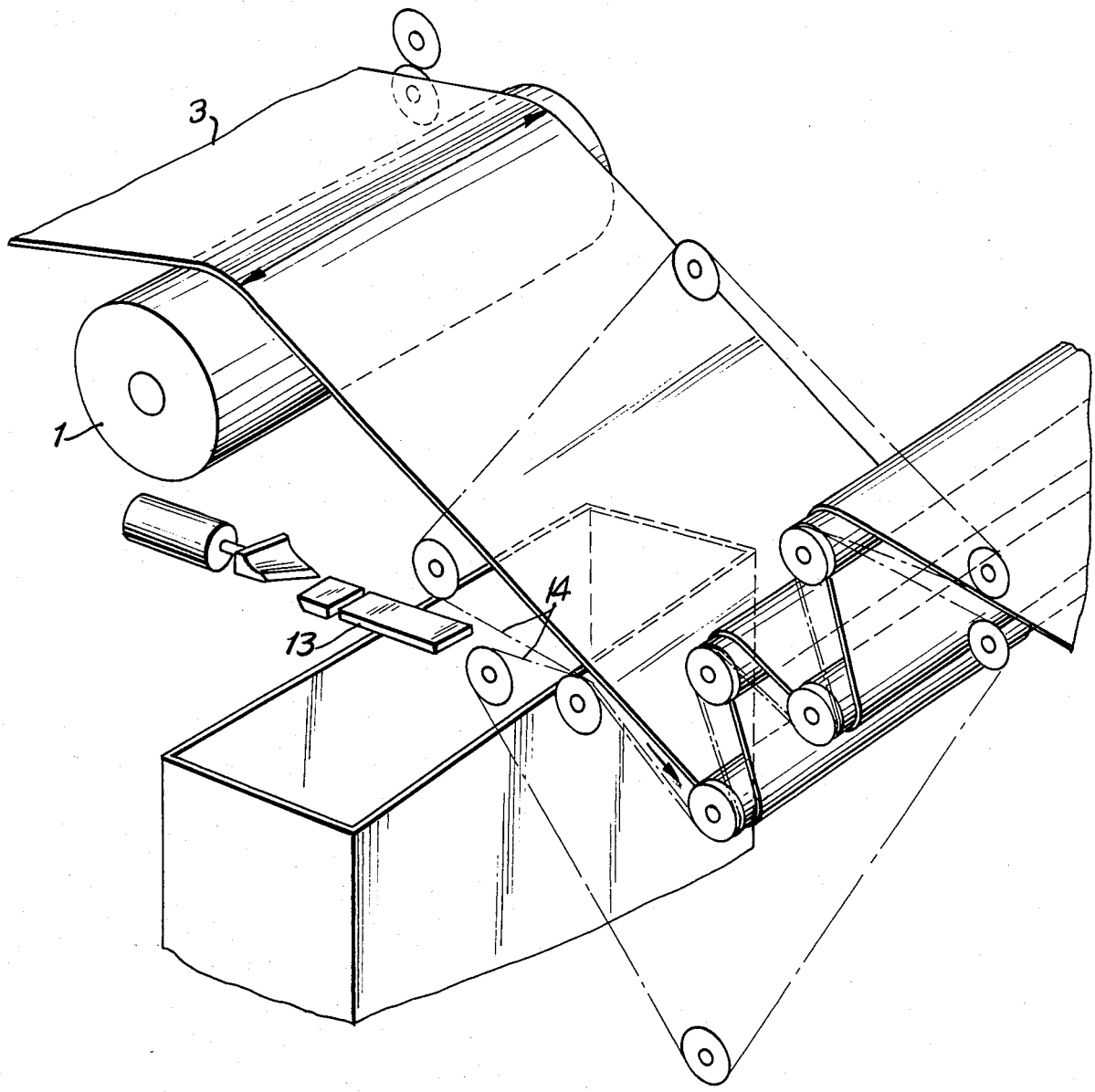
FIG. 9 is a perspective view when the web is running in full width, the initial severing device being in its final position.
Figure 10:
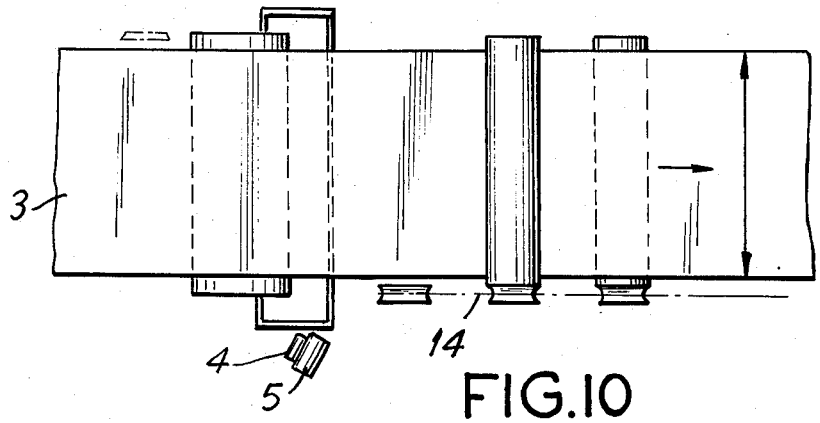
FIG. 10 is a plan view corresponding to FIG. 9.

A separating device 20, which can be shifted laterally from the position shown in full in FIG. 3 to the final position shown in broken lines, cuts a strip 2 from a web 3 running over a roll 1. Initially the strip 2 and balance of the web 3 trace downwardly or vertically and pass into a waste collector 21. A pair of pressure rolls 4 and 5 grasps the strip 2. One roll 5 in the pair is driven by a motor 6. The other roll 4 is rubberized and forced against roll 5 in such a way that the traveling strip 2 is secured and simultaneously advanced without tension.

Then cylinder-and-piston unit 8 comes into action and pivots rolls 4, 5 around vertical axes 9 by means of lever parallelogram 7 in such a way that the strip is displaced laterally relative to its original vertical web path.

Immediately thereafter, separation is initiated perpendicular to the verticular horizontally by a previously charged compressed-air cylinder 10 that moves a transverse knife 11 towards strip 2. The trimming speed of knife 11 approximately equals the speed of web 3. Since the contour of knife 11 matches that of roll 5, the direction in which the initial section of trimmed strip 2 will travel is predetermined. Strip 2 is diverted out of the vertical into the horizontal through the gap between the guide surface 12 on the advanced knife 11 (indicated by the broken lines) and pressure roll 5 and conveyed over a feed surface 13 to transport ropes 14 forming a rope scissors which advances it farther.

Once the initial section of strip 2 has been grasped by the transport ropes 14 in the rope scissors, it is clamped in by the transport ropes that are being advanced in common and conveyed through the downstream treatment and processing machine. As soon as the initial section leaves the machine, the separating device 20 upstream of roll 1 is set into motion along the guide transverse to the direction being traveled by the web. The web of material being introduced develops a taper, the angle depending on how rapidly the separating device moves transversely. Thus, the total width of the web is gradually introduced into the downstream treatment or processing machine.

At the moment the forward edge of transversely severed strip 2 has passed through the downstream treatment or processing machine rolls 4 and 5 will terminate their guiding operation and release strip 2 by swinging out farther.

It is noted that transport ropes 14 are positioned laterally relative to the overall web width, next to the downstream treatment machine so they are inactive once the web 3 is moving normally in full width to the downstream processing machine.

The whole device can be rotated up or down around a horizontal axis 16 into various angular positions in special cases by skin cylinders, not shown, to obtain specific infeed approaches.

It will be understood that the specification and examples are illustrative but not limitative of the present invention and that other embodiments within the spirit and scope of the invention will suggest themselves to those skilled in the art.

I claim:

1. An apparatus for introducing a web of material into a processing machine, comprising: a knife for separating a strip from one edge of the web; means downstream of the knife for conveying the web and the strip vertically downwardly including a pair of driven pressure rollers downstream of the knife for grasping the strip therebetween; means downstream of the rollers for diverting the strip out of its vertical path into a horizontal path which is to one side and perpendicular to the web including a rope scissors and a transverse knife disposed between the driven rollers and the rope scissors for severing the strip to form a leading edge of the strip and having a guide surface thereon for directing the leading edge of the strip in the horizontal path into the rope scissors; and means for pivoting the pressure rolls around a vertical axis.

2. The apparatus according to claim 1, wherein the guide surface on the transverse knife conforms to the periphery of one pressure roll.

3. The apparatus according to claim 1, further comprising means for pivoting the knife, conveying means, diverting means and pivoting means about a horizontal axis.

* * * * *